US012378044B1

(12) United States Patent
Hu et al.

(10) Patent No.: US 12,378,044 B1
(45) Date of Patent: Aug. 5, 2025

(54) PRESS-TYPE CUP LID

(71) Applicant: ZHEJIANG COOLESTS TECHNOLOGY CO., LTD., Jinhua (CN)

(72) Inventors: Weizhen Hu, Jinhua (CN); Changgen Ying, Jinhua (CN)

(73) Assignee: Zhejiang Coolests Technology Co., Ltd., Jinhua (CN)

( * ) Notice: Subject to any disclaimer, the term of this patent is extended or adjusted under 35 U.S.C. 154(b) by 0 days.

(21) Appl. No.: 19/062,008

(22) Filed: Feb. 24, 2025

Related U.S. Application Data

(63) Continuation of application No. PCT/CN2024/099151, filed on Jun. 14, 2024.

(51) Int. Cl.
*B65D 47/24* (2006.01)

(52) U.S. Cl.
CPC ..... *B65D 47/243* (2013.01); *B65D 2205/02* (2013.01)

(58) Field of Classification Search
CPC ..... B65D 47/243; B65D 2205/02
See application file for complete search history.

(56) References Cited

U.S. PATENT DOCUMENTS 5,427,271 A * 6/1995 Wang ..... A47G 19/2272 220/255
8,978,923 B2 * 3/2015 George ..... B65D 43/0225 215/311
11,472,611 B1 * 10/2022 Hove ..... B65D 47/14
2016/0106241 A1 * 4/2016 Wong ..... B65D 47/32 220/254.5
2017/0081092 A1 * 3/2017 Gregory ..... B65D 47/249
2017/0327282 A1 * 11/2017 Choltco-Devlin ..... A47G 19/2272
2023/0219723 A1 7/2023 Li et al.

FOREIGN PATENT DOCUMENTS

CN 206381028 U 8/2017
CN 216724052 U 6/2022
CN 220192695 U 12/2023
(Continued)

OTHER PUBLICATIONS

PCT International Search Report and Written Opinion, dated Dec. 23, 2024, for PCT/CN2024/099151, total 7 pages.

*Primary Examiner* — Donnell A Long
(74) *Attorney, Agent, or Firm* — Mei & Mark LLP; Manni Li

(57) ABSTRACT

A press-type cup lid comprises an upper lid, an inner lid, and a hollow outer lid. The inner lid is fixedly connected to the outer lid, and upper lid is slidably connected to outer lid; at least two first through holes are uniformly arranged on a wall of the inner lid, the upper lid is provided with push-press portion, and receiving space for receiving the push-press portion is formed between wall of inner lid and wall of outer lid. A second through hole or a groove is formed on push-press portion; the second through hole or groove corresponds to the first through hole in position; when upper lid is pressed downward, the first through hole is aligned and communicated with the second through hole or groove, such that rolling body rolls at an interpenetration of the first through hole and the second through hole or groove.

10 Claims, 8 Drawing Sheets

(56) References Cited

FOREIGN PATENT DOCUMENTS

| | | | |
|---|---|---|---|
| CN | 117918677 | A | 4/2024 |
| CN | 220735082 | U | 4/2024 |
| CN | 220937599 | U | 5/2024 |
| WO | 2023123671 | A1 | 7/2023 |

* cited by examiner

PRESS-TYPE CUP LID

CROSS-REFERENCE TO RELATED APPLICATION

The subject application is a continuation of PCT international stage application PCT/CN2024/099151 filed on Jun. 14, 2024. The subject application claims priority to the PCT international stage application PCT/CN2024/099151, which is incorporated by reference herein in its entirety.

TECHNICAL FIELD

The present invention relates to liquid containers, and particularly, a press-type cup lid.

BACKGROUND ART

There has always been a need for a lid unit (plug body) capable of being easily assembled and disassembled on a neck portion of a container body with an upper opening. Chinese Patent Publication No. CN216724052U discloses a novel push-type cup lid, the specification and accompanying drawings thereof describe "a novel push-type cup lid, comprising an outer lid and an inner lid for being connected to a cup body; an inner side of the outer lid is provided with a latching portion, and an outer side of the inner lid is provided with a latching groove corresponding to the latching portion; when the outer lid is connected to the inner lid, the latching portion cooperates with the latching groove; the outer lid is provided with an active button, the outer lid has an inner cavity, the active button is in transmission connection with a pressure relief column for making the inner cavity communicate with or seal the cup body, and the active button is further connected to a transmission mechanism that separates the latching portion from the latching groove; and when the active button moves downward, the inner cavity is communicated with the cup body, and the latching portion is separated from the latching groove." Adopting the principle of stationary and rotating gears, the cup lid has a rotating latching portion and a stationary latching groove structure, the active button, in combination with the transmission mechanism and the pressure relief column, opens and closes a liquid flow path. The transmission structure comprises a first transmission portion, a second transmission portion, and a support portion. However, the structure is very complex and requires high precision, making it difficult to be assembled. Moreover, it is prone to jamming during use, resulting in poor operation.

SUMMARY OF THE INVENTION

The present invention provides a press-type cup lid, which solves the problems of complex structure, inconvenient mounting, and unsmooth operation of the press-type cup lids in the existing technology.

The present invention provides a press-type cup lid, which comprises an upper lid, an inner lid, and a hollow outer lid, where the inner lid is a lid body with an opening at a lower end, and at least two first through holes are uniformly arranged on a wall of the inner lid; the upper lid is a lid body with an opening at a lower end, the upper lid is provided with a push-press portion, and the push-press portion protrudes from a lower edge of the opening of the upper lid; the inner lid is fixedly connected to the outer lid, the upper lid is slidably connected to the outer lid, the push-press portion is arranged between the wall of the inner lid and a wall of the outer lid, and a rolling body is arranged between the push-press portion and the first through hole; a second through hole or a groove is formed on the push-press portion, and the second through hole or the groove corresponds to the first through hole in position, and has a quantity same as that of the first through hole; and when the upper lid is pressed downward, the first through hole is aligned and communicated with the second through hole or the groove, such that the rolling body rolls at an interpenetration of the first through hole and the second through hole or the groove; and the inner lid is elastically connected to the upper lid.

In the present invention, a rolling body slide slot is formed below the second through hole or the groove of the push-press portion; and when the second through hole or the groove is misaligned with the first through hole, the rolling body slide slot will squeeze the rolling body outward towards the first through hole.

In the present invention, the inner lid is elastically connected to the upper lid via a first return spring.

In the present invention, a third through hole is formed at a center of a top of the inner lid, a venting mechanism is arranged inside the inner lid, the venting mechanism comprises a sealing cap and a connecting rod, the connecting rod passes through the third through hole and is located in a space between the top of the inner lid and a top of the upper lid, and the sealing cap is located below the third through hole.

In the present invention, a sealing ring mounting part is arranged inside the inner lid, a third through hole is formed at a center of a top of the inner lid, and a fourth through hole in communication with the third through hole is formed on the sealing ring mounting part; a venting mechanism is arranged inside the inner lid, the venting mechanism comprises a sealing cap and a connecting rod, and the connecting rod passes through the fourth through hole and the third through hole, and is located in a space between the top of the inner lid and the top of the upper lid, and the sealing cap is located below the fourth through hole.

In the present invention, a limiting portion is arranged at a top of the connecting rod, a second return spring is arranged and sleeved over the connecting rod, and the second return spring is located between the limiting portion and the top of the inner lid.

In the present invention, a third through hole is formed at a center of a top of the inner lid, a fifth through hole is formed at the top of the upper lid, and the fifth through hole is aligned and communicated with the third through hole; a first spring seat is arranged at the fifth through hole at the top of the upper lid, a second spring seat is arranged at the third through hole at the top of the inner lid, and two ends of the first return spring are respectively sleeved on the first spring seat and the second spring seat.

In the present invention, a sealing ring mounting part is arranged inside the inner lid, a fourth through hole is formed on the sealing ring mounting part, and the third through hole, the fourth through hole, and the fifth through hole are aligned and communicated with one another.

In the present invention, a straw is also arranged, and the straw passes through the third through hole, the fourth through hole, and the fifth through hole.

In the present invention, an inner wall of the outer lid is provided with a retaining strip or a retaining groove, while an outer wall of the inner lid is correspondingly provided with the retaining groove or the retaining strip, and the outer lid is fixedly connected to the inner lid through the retaining strip or the retaining groove.

The present invention has the following advantages. Firstly, it is convenient to place the cup lid on the cup opening. When pressure is placed on the cup opening and then release, the cup lid will be locked on the cup opening. Secondly, the diameter of the first through hole is smaller than the maximum diameter of the rolling body, the space between the inner lid and the push-press portion is fully utilized to ensure that the rolling body neither pass through the first through hole nor fall off from the lid body. Thirdly, the misalignment of the rolling body between the first through hole and the second through hole or the groove is cleverly utilized, the part of the rolling body protruding from the first through hole cooperates with the cup opening retaining groove to have the cup lid tightly placed on the cup opening; and the first through hole is aligned and communicated with the second through hole or the groove, the cup opening is pressed downward, and the rolling body is then squeezed toward the second through hole or the groove to have the cup lid removed. Fourthly, the structure of the present invention can be a common press-type cup lid, or can be designed as a direct-drinking cup lid, or a cup lid for inserting a straw. Fifthly, the present invention has a simple structure, with fewer components, easy to process and assemble, and low mold investment cost.

Figure 1:
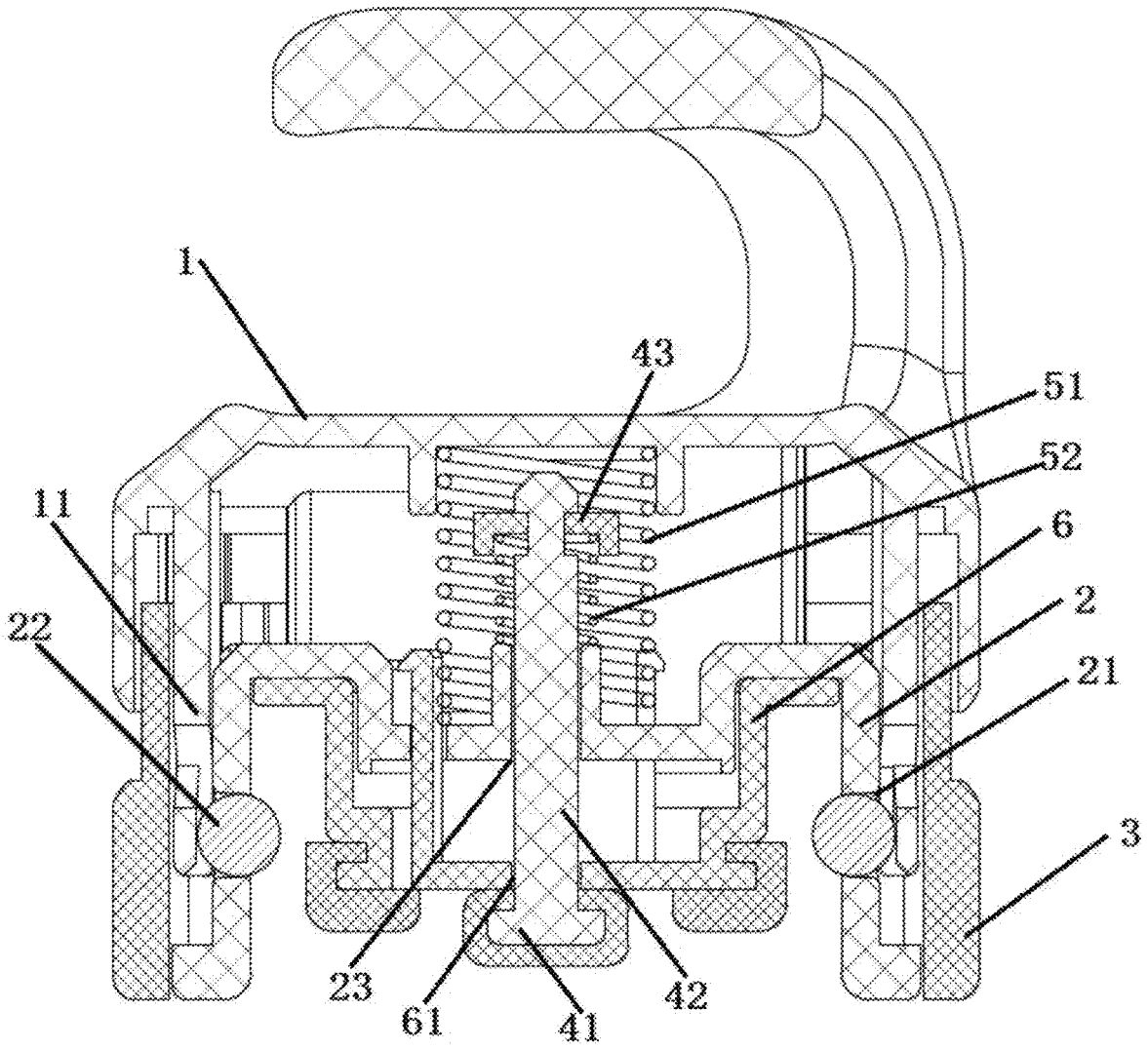
FIG. 1 is a sectional view showing the structure in a first embodiment of the present invention.

Reference numerals in the accompanying drawings refer to the following structures: 1—upper lid; 11—push-press portion; 12—second through hole; 13—rolling body slid slot; 14—first spring seat; 15—fifth through hole; 2—inner lid; 21—first through hole; 22—rolling body; 23—third through hole; 24—second spring seat; 25—retaining groove; 3—outer lid; 31—retaining strip; 41—sealing cap; 42—connecting rod; 43—limiting portion; 51—first return spring; 52—second return spring; 6—sealing ring mounting part; 61—fourth through hole; 7—cup body; and 71—cup opening retaining groove.

DETAILED DESCRIPTION OF THE INVENTION

The present invention will be further described below with reference to the accompanying drawings. The accompanying drawings are for illustrative purposes only and are not to be construed as limiting the present invention.

In order to more concisely describe the present invention, some parts well known to those skilled in the art but unrelated to the main content of the present invention may be omitted in the accompanying drawings or the description. In addition, for the convenience of description, some parts in the accompanying drawings can be omitted, enlarged or reduced, but do not represent a size or an entire structure of an actual product.

Figure 2:
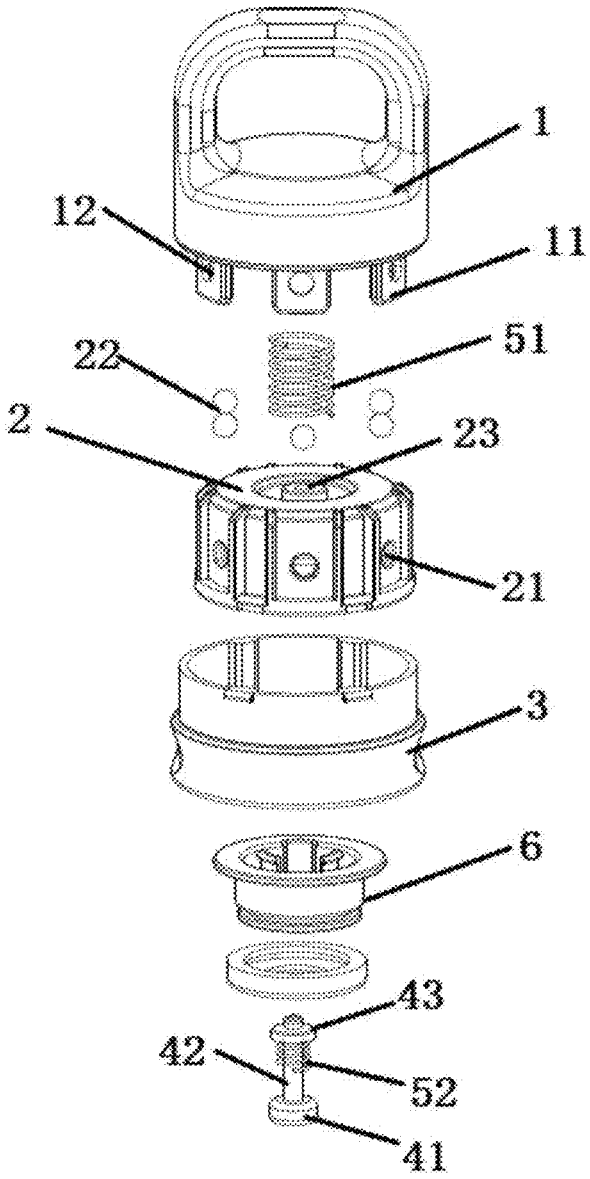
FIG. 2 is an exploded view showing the first embodiment of the present invention.

The present invention provides a press-type cup lid, as shown in FIGS. 1 and 2, which comprises an upper lid 1, an inner lid 2, and a hollow outer lid 3.

Figure 4:
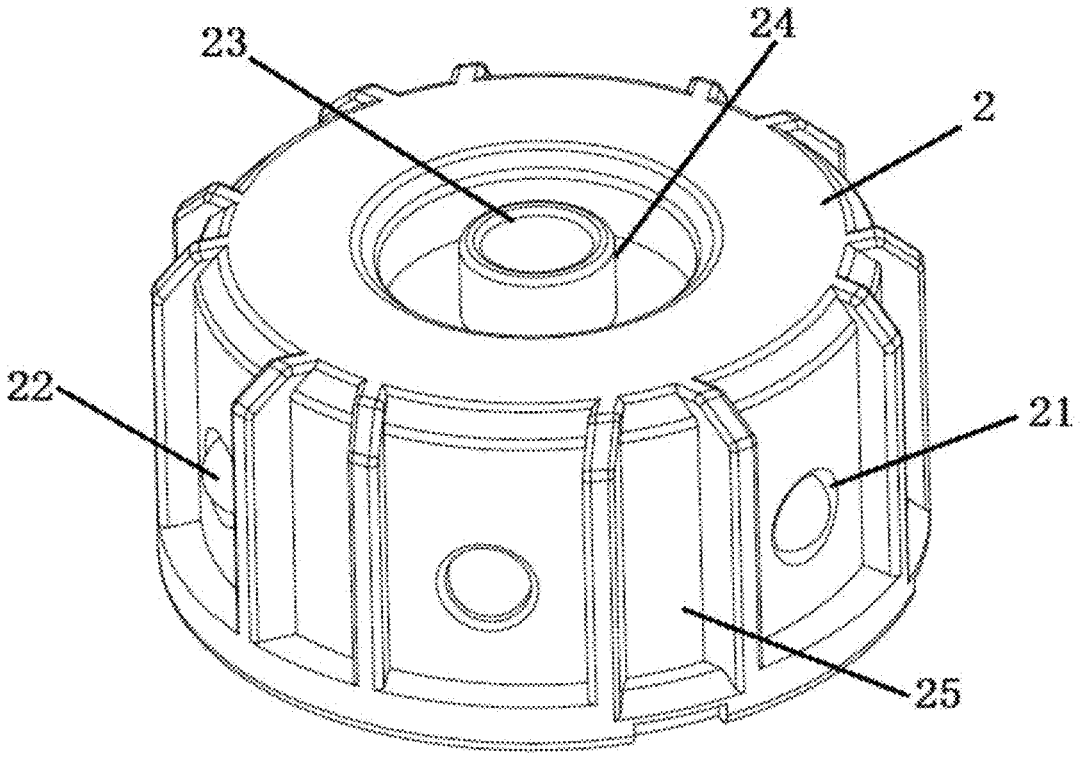
FIG. 4 shows the structure of the inner lid in the present invention.
Figure 5:
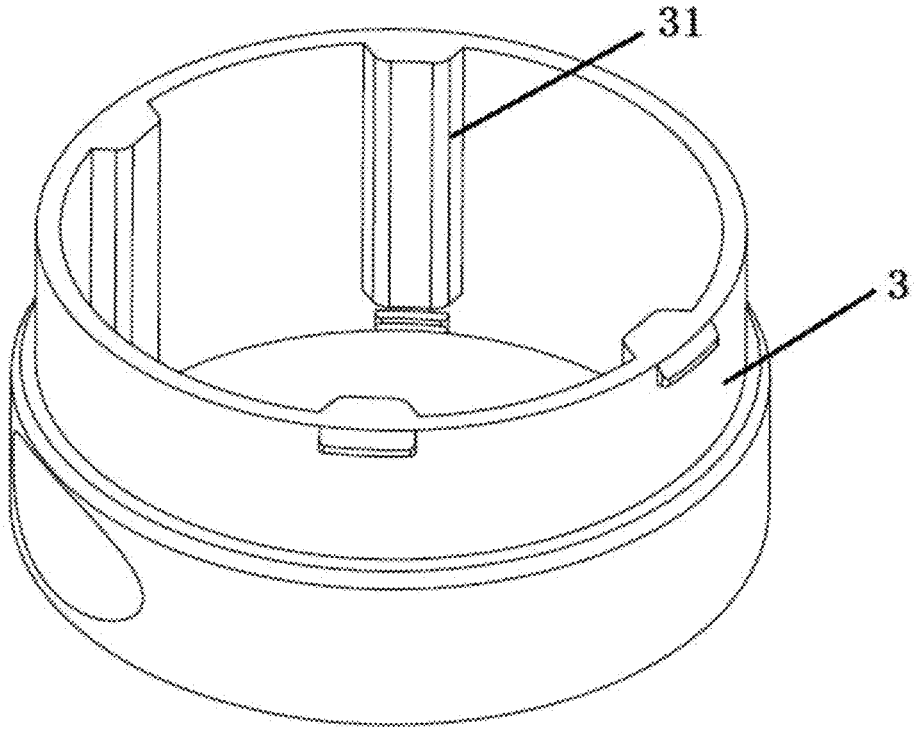
FIG. 5 shows the structure of the outer lid in the present invention.

The outer lid 3 and the inner lid 2 are fixedly connected, as shown in FIGS. 4 and 5, and the outer lid 3 is fixedly connected to the inner lid 2 via a retaining strip 31 and a retaining groove 25. Specifically, an inner wall of the outer lid 3 can be provided with the retaining strip 31, and the retaining groove 25 corresponding to the retaining strip can be arranged on an outer wall of the inner lid 2; alternatively, the inner wall of the outer lid 3 can be provided with the retaining groove 25, and the retaining strip 31 corresponding to the retaining groove 25 can be arranged on the outer wall of the inner lid 2.

The inner lid 2 is a lid body with an opening at a lower end, and at least two first through holes 21 are uniformly arranged on a wall of the inner lid 2.

Figure 3:
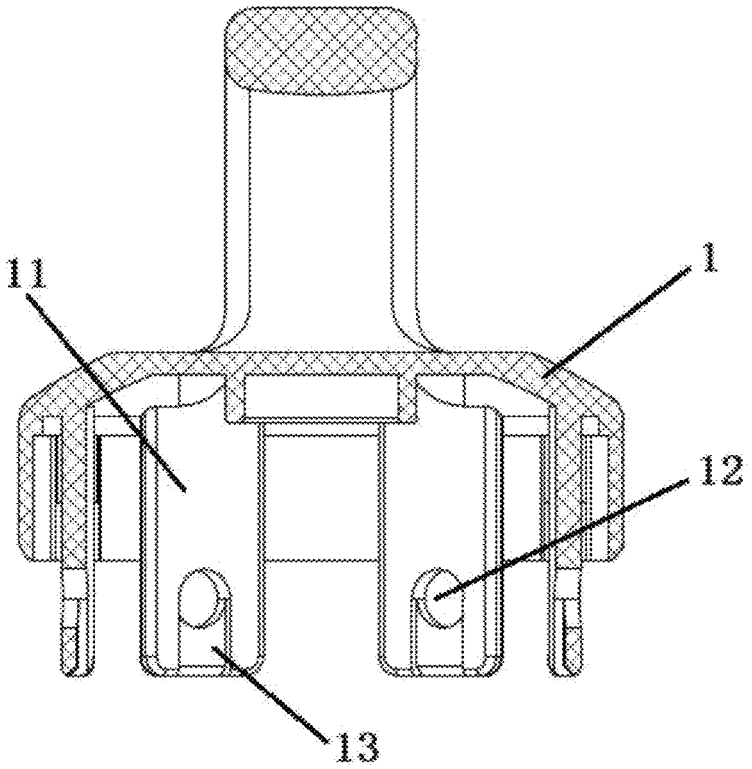
FIG. 3 is a sectional view showing the structure of the upper lid in the first embodiment of the present invention.
Figure 7:
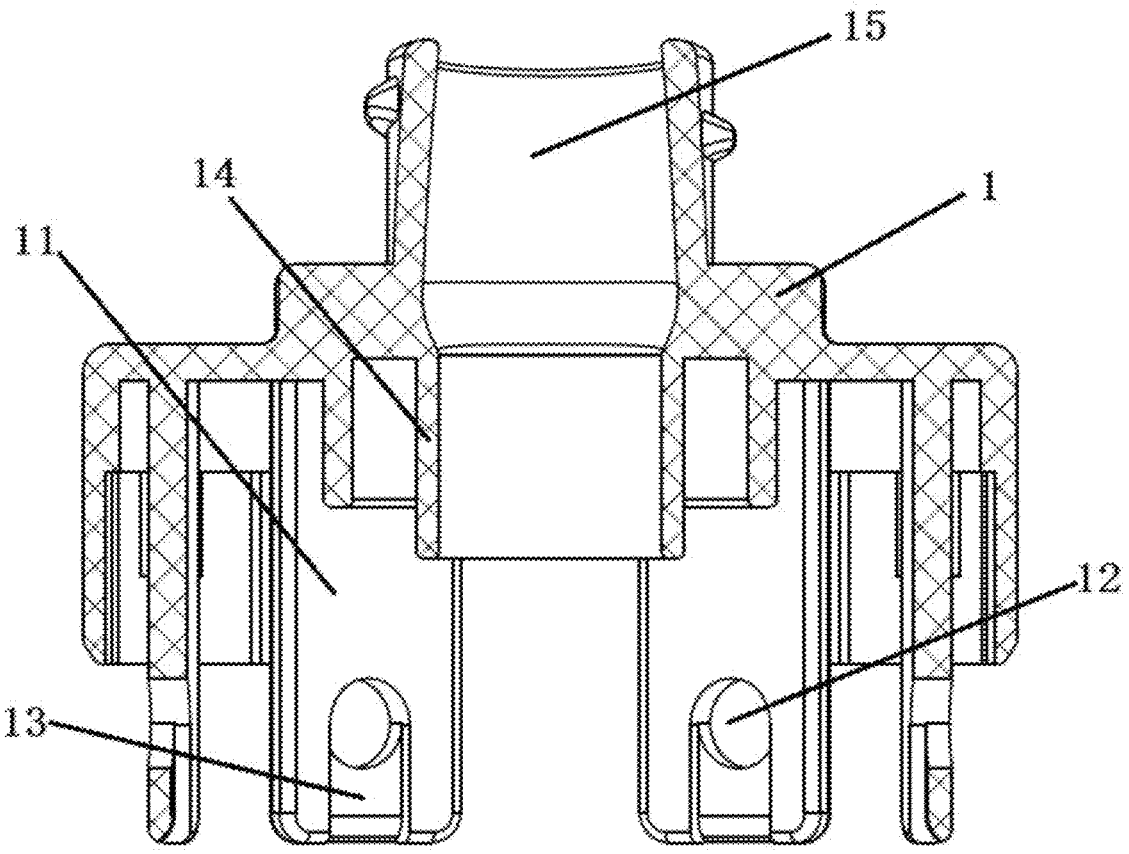
FIG. 7 is a sectional view showing the upper lid in the second embodiment of the present invention.

As shown in FIGS. 3 and 7, the upper lid 1 is a lid body with an opening at a lower end, the upper lid 1 is provided with a push-press portion 11, the push-press portion 11 protrudes from a lower edge of the opening of the upper lid 1, a second through hole 12 or a groove is formed on the push-press portion 11, and the second through hole 12 or the groove corresponds to the first through hole 21 in position, and has a same number same as those of the first through hole.

The push-press portion 11 can be inserting sheets arranged around an inner wall of the upper lid 1, the inserting sheets can be provided with the second through holes 12 or the grooves, which are arranged in a one-to-one correspondence with the first through holes 21 in a same quantity, or independent inserting strips are arranged in a one-to-one correspondence with the first through holes 21, as shown in FIG. 3, and each of the inserting strips can be provided with one of the second through holes 12 or the groove.

The inner lid 2 is fixedly connected to the outer lid 3, the upper lid 1 is slidably connected to the outer lid 3, and the upper lid 1 can move up and down relative to the outer lid 3; and a receiving space for receiving the push-press portion 11 is formed between the wall of the inner lid 2 and a wall of the outer lid 3, the push-press portion 11 is arranged inside the receiving space, a rolling body 22 is arranged inside a space formed by the first through hole 21 and the push-press portion 11, and a diameter of the first through hole 21 is smaller than a maximum diameter of the rolling body 22, such that the rolling body 22 can partially protrude from the first through hole 21, but cannot be squeezed out of the first through hole 21. Since the inner lid 2 is fixedly connected to the outer lid 3, the rolling body 22 is prevented from falling off. The rolling body 22 is usually a steel ball.

When the upper lid 1 is pressed downward, the first through hole 21 is aligned and communicated with the second through hole 12 or the groove, such that the rolling body 22 rolls at an interpenetration of the first through hole 21 and the second through hole 12 or the groove.

As shown in FIGS. 1, 3, 6, and 7, a rolling body slide slot 13 is formed below the second through hole 12 or the groove of the push-press portion 11. When the push-press portion 11 is set as a groove, a depth of the rolling body slide slot 13 is shallower than a depth of the groove, this is because the groove serves as a retreat path for the rolling body 22 when it retracts from the first through hole 21, and a deeper groove allows more of the rolling body 22 to exit from the first through hole 21, facilitating the opening of the lid. The rolling body slide slot 13 is designed to squeeze the rolling body 22, a shallower depth of the rolling body slide slot 13 can ensure that the rolling body 22 protrudes outward more from the first through hole 21, such that the cup lid can be closed more tightly. Therefore, when the second through hole 12 or the groove is misaligned with the first through hole 21, the rolling body slide slot 13 will squeeze the rolling body 22 outward towards the first through hole 21.

The inner lid 2 is elastically connected to the upper lid 1; specifically, the inner lid 2 is elastically connected to the upper lid 1 via a first return spring 51.

Figure 8:
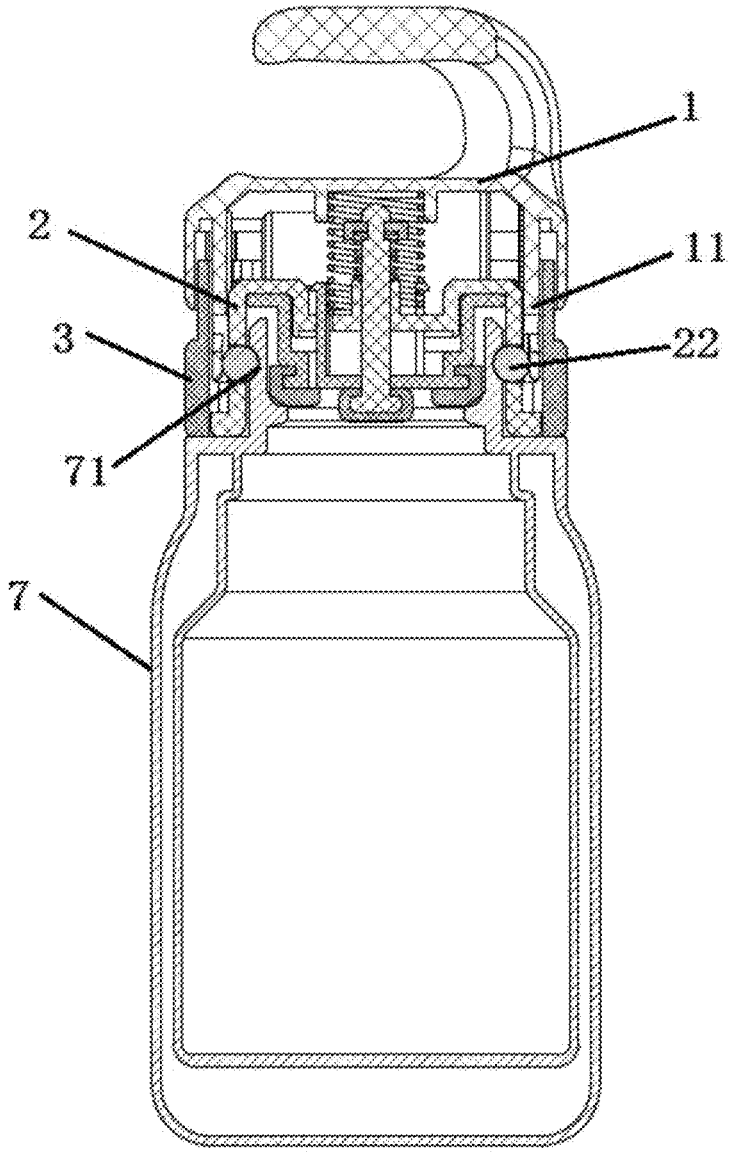
FIG. 8 is a sectional view showing the first embodiment of the present invention in a use state.
Figure 9:
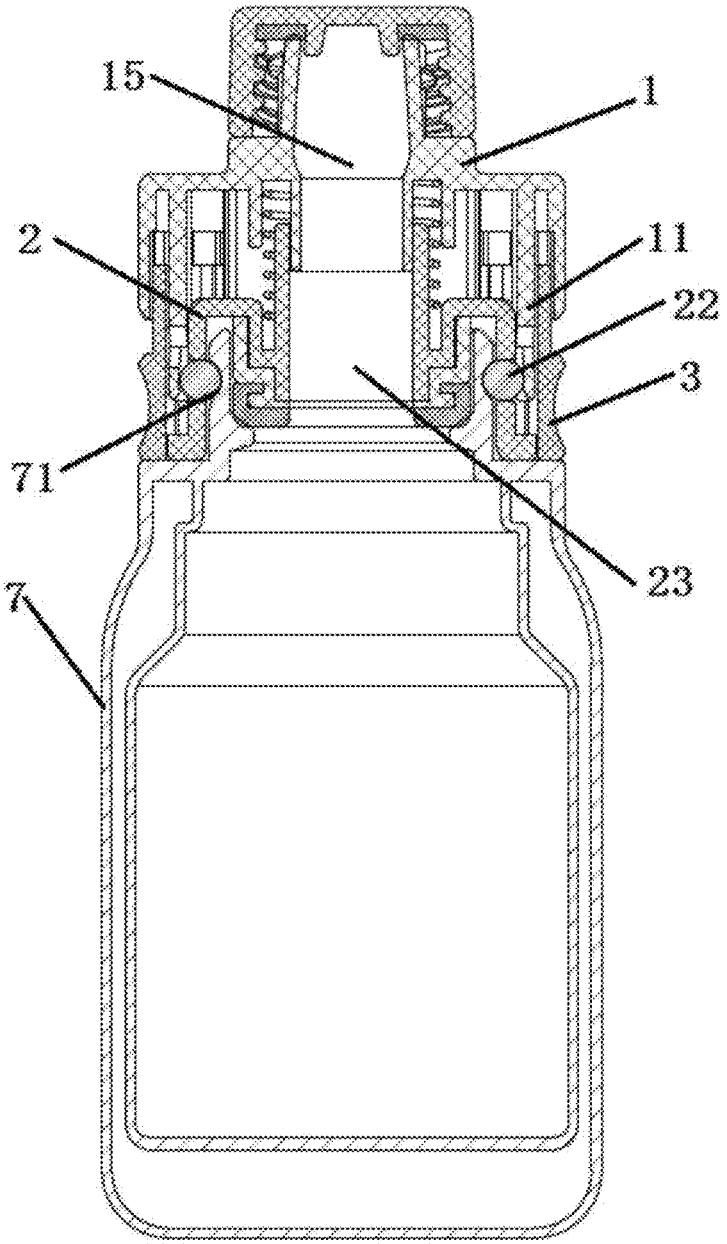
FIG. 9 is a sectional view showing the second embodiment of the present invention in a use state.

FIGS. 8 and 9 are schematic diagrams that the present invention is applied to a cup body 7. When the cup lid in the present invention needs to be placed on an opening of the cup, the upper lid 1 is pressed downward, the first through hole 21 is aligned and communicated with the second through hole 12 or the groove, the rolling body 22 rolls toward the second through hole 12 or groove under a pressure of the cup opening, and the cup lid is closed on the cup opening. Upon release, the upper lid 1 is lifted under the action of the first return spring 51, the second through hole 12 or the groove is misaligned with the first through hole 21, the rolling body slid slot 13 squeezes the rolling body 22 outward towards the first through hole 21, and a part of the rolling body 22 protruding from the first through hole 21 fits into the a cup opening retaining groove 71, such that the cup lid is completely covered by the cup opening and cannot be pulled out. When it is necessary to open the cup lid, the upper lid 1 is pressed downward, the first through hole 21 is aligned and communicated with the second through hole 12 or the groove, the outer lid 3 can be pinched and pulled upwards together with the upper lid 1, and the rolling body 22 rolls towards the second through hole 12 or the groove under a pressure of the cup opening and is disengaged from the cup opening retaining groove 71, and the cup lid is opened.

The press-type cup lid of the present invention has at least the following two embodiments.

First Embodiment

As shown in FIGS. 1-3 and 7, a third through hole 23 is formed at a center of a top of the inner lid 2, a venting mechanism is arranged inside the inner lid 2, the venting mechanism comprises a sealing cap 41 and a connecting rod 42, the connecting rod 42 passes through the third through hole 23 and is located in a space between the top of the inner lid 2 and a top of the upper lid 1, and the sealing cap 41 is located below the third through hole 23.

A limiting portion 43 is arranged at a top of the connecting rod 42, a second return spring 52 is arranged and sleeved over the connecting rod 42, and the second return spring 52 is located between the limiting portion 43 and the top of the inner lid 2.

Therefore, to open the cup lid, the upper lid 1 is pressed downward, and the top of the upper lid 1 presses down on the connecting rod 42 move toward, such that the sealing cap 41 is moved away from the third through hole 23, thereby realizing exhaust.

In order to maintain thermal insulation and sealing, a sealing ring mounting part 6 is arranged inside the inner lid 2, a third through hole 23 is formed at a center of a top of the inner lid 2, and a fourth through hole 61 in communication with the third through hole 23 is formed on the sealing ring mounting part 6; and the connecting rod 42 of the venting mechanism passes through the fourth through hole 61 and the third through hole 23 and is located in a space between the top of the inner lid 2 and the top of the upper lid 1, and the sealing cap 41 is located below the fourth through hole 61, such that when the cup lid is opened, the upper lid 1 is pressed downward, and the top of the upper lid 1 presses down on the connecting rod 42 move toward, such that the sealing cap 41 is moved away from the fourth through hole 61, thereby realizing exhaust.

A sealing ring can be mounted at the sealing ring mounting part 6 to ensure thermal insulation and sealing effects.

Second Embodiment

Figure 6:
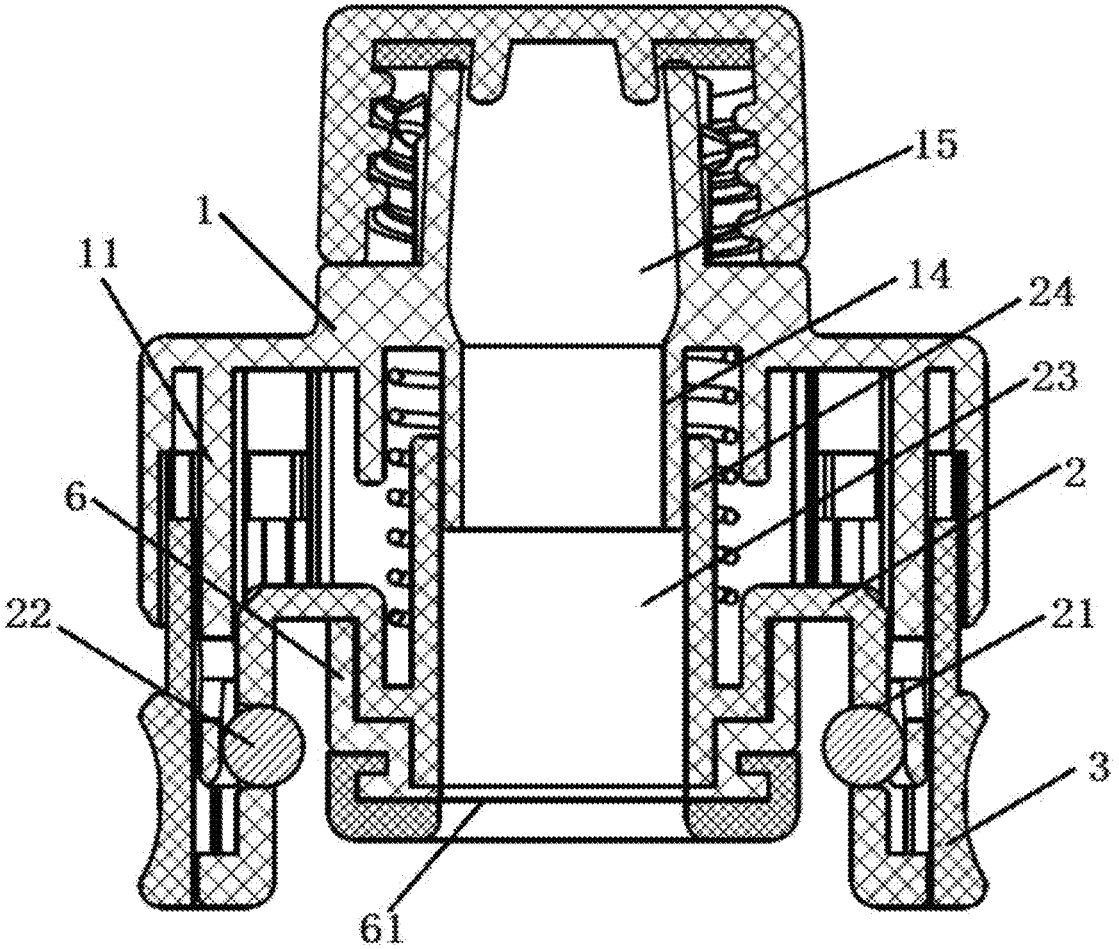
FIG. 6 is a sectional view showing the structure of the second embodiment of the present invention.

As shown in FIGS. 6, 7, and 9, a direct-drink design is provided.

A third through hole 23 is formed at a center of a top of the inner lid 2, a fifth through hole 15 is formed at the top of the upper lid 1, and the fifth through hole 15 is aligned and communicated with the third through hole 23 to form a liquid flow path.

A first spring seat 14 is arranged at the fifth through hole 15 at the top of the upper lid 1, a second spring seat 24 is arranged at the third through hole 23 at the top of the inner lid 2, and two ends of the first return spring 51 are respectively sleeved on the first spring seat 14 and the second spring seat 24.

In order to maintain thermal insulation and sealing, a sealing ring mounting part 6 is arranged inside the inner lid 2, a fourth through hole 61 is formed on the sealing ring mounting part 6, and the third through hole 23, the fourth through hole 61, and the fifth through hole 15 are aligned and communicated with one another to form a liquid flow path.

A straw can also be arranged inside the liquid flow path, and the straw passes through the third through hole 23, the fourth through hole 61, and the fifth through hole 15.

In the present invention, through the communication or misalignment of the rolling body in the first through hole and the second through hole or the groove, the press-type cup lid realizes the removal or sealing of the cup lid, featuring a simple structure, and convenient operation.

The above-mentioned contents are merely preferred examples of the present invention and are not intended to limit the implementation scope of the present invention, that is, all equivalent changes and modifications made according to the contents of the patent scope of the present invention shall fall within the technical scope of the present invention.

We claim:

1. A press-type cup lid, comprising an upper lid (1), an inner lid (2), and a hollow outer lid (3), wherein the inner lid (2) is a lid body with an opening at a lower end, and at least two first through holes (21) are uniformly arranged on a wall of the inner lid (2);

the upper lid (1) is a lid body with an opening at a lower end, the upper lid (1) is provided with a push-press portion (11), and the push-press portion (11) protrudes from a lower edge of the opening of the upper lid (1);

the outer lid (3) is fixedly connected to the inner lid (2), the upper lid (1) is slidably connected to the outer lid (3), the push-press portion (11) is arranged between the wall of the inner lid (2) and a wall of the outer lid (3), and a rolling body (22) is arranged between the push-press portion (11) and the first through hole (21);

a second through hole (12) or a groove is formed on the push-press portion (11), and the second through hole (12) or the groove corresponds to the first through hole (21) in position, and has a quantity same as that of the first through hole; and when the upper lid (1) is pressed downward, the first through hole (21) is aligned and communicated with the second through hole (12) or the groove, such that the rolling body (22) rolls at an interpenetration of the first through hole (21) and the second through hole (12) or the groove; and the inner lid (2) is elastically connected to the upper lid (1).

2. The press-type cup lid according to claim 1, wherein a rolling body slide slot (13) is formed below the second through hole (12) or the groove of the push-press portion (11); and when the second through hole (12) or the groove is misaligned with the first through hole (21), the rolling body slide slot (13) will squeeze the rolling body (22) outward towards the first through hole (21).

3. The press-type cup lid according to claim 1, wherein the inner lid (2) is elastically connected to the upper lid (1) via a first return spring (51).

4. The press-type cup lid according to claim 3, wherein a third through hole (23) is formed at a center of a top of the inner lid (2), a venting mechanism is arranged inside the inner lid (2), the venting mechanism comprises a sealing cap (41) and a connecting rod (42), the connecting rod (42) passes through the third through hole (23) and is located in a space between the top of the inner lid (2) and a top of the upper lid (1), and the sealing cap (41) is located below the third through hole (23).

5. The press-type cup lid according to claim 3, wherein a sealing ring mounting part (6) is arranged inside the inner lid (2), a third through hole (23) is formed at a center of a top of the inner lid (2), and a fourth through hole (61) in communication with the third through hole (23) is formed on the sealing ring mounting part (6); and a venting mechanism is arranged inside the inner lid (2), the venting mechanism comprises a sealing cap (41) and a connecting rod (42), and the connecting rod (42) passes through the fourth through hole (61) and the third through hole (23), and is located in a space between the top of the inner lid (2) and the top of the upper lid (1), and the sealing cap (41) is located below the fourth through hole (61).

6. The press-type cup lid according to claim 4, wherein a limiting portion (43) is arranged at a top of the connecting rod (42), a second return spring (52) is arranged and sleeved over the connecting rod (42), and the second return spring (52) is located between the limiting portion (43) and the top of the inner lid (2).

7. The press-type cup lid according to claim 3, wherein a third through hole (23) is formed at a center of a top of the inner lid (2), a fifth through hole (15) is formed at the top of the upper lid (1), and the fifth through hole (15) is aligned and communicated with the third through hole (23); a first spring seat (14) is arranged at the fifth through hole (15) at the top of the upper lid (1), a second spring seat (24) is arranged at the third through hole (23) at the top of the inner lid (2), and two ends of the first return spring (51) are respectively sleeved on the first spring seat (14) and the second spring seat (24).

8. The press-type cup lid according to claim 7, wherein a sealing ring mounting part (6) is arranged inside the inner lid (2), a fourth through hole (61) is formed on the sealing ring mounting part (6), and the third through hole (23), the fourth through hole (61), and the fifth through hole (15) are aligned and communicated with one another.

9. The press-type cup lid according to claim 8, wherein a straw is arranged, and the straw passes through the third through hole (23), the fourth through hole (61), and the fifth through hole (15).

10. The press-type cup lid according to claim 1, wherein an inner wall of the outer lid (3) is provided with a retaining strip (31) or a retaining groove (25), while an outer wall of the inner lid (2) is correspondingly provided with the retaining groove (25) or the retaining strip, and the outer lid (3) is fixedly connected to the inner lid (2) through the retaining strip (31) or the retaining groove (25).

* * * * *